US005666764A

United States Patent [19]

Beatty et al.

[11] Patent Number: 5,666,764

[45] Date of Patent: Sep. 16, 1997

[54] FIXED HINGE-DOOR REMOVAL/DOOR SEAL RESOLUTION

[75] Inventors: Scott M. Beatty; David Foss; James L. Willis, all of Fort Smith, Ark.

[73] Assignee: Whirlpool Corporation, Benton Harbor, Mich.

[21] Appl. No.: 344,444

[22] Filed: Nov. 23, 1994

[51] Int. Cl.[6] ..... E05D 7/00

[52] U.S. Cl. ..... 49/397; 49/381; 16/254; 312/405; 403/386; 403/393

[58] Field of Search ..... 16/223, 254, 270; 312/138.1, 326, 405; 29/434, 525.02, 525.03, 525.04, 525.11, 525.12, 525.13, 525.15, 407.09, 407.1; 49/381, 397; 403/384, 386, 393; 248/284.1

[56] References Cited

U.S. PATENT DOCUMENTS 3,290,109 12/1966 Vanegas ..... 312/326

4,170,391 10/1979 Bottger ..... 312/405

*Primary Examiner*—Joseph M. Gorski

*Attorney, Agent, or Firm*—Thomas J. Roth; Robert O. Rice; Mark A. Davis

[57] ABSTRACT

An improved refrigerator hinge assembly which provides for maintaining the proper adjusted position of a refrigerator door with respect to its associated cabinet. A factory setting of the refrigerator door can be accurately maintained with precision even after the hinges are removed for field installation of the refrigerator such as to pass a refrigerator through narrow doorways. A tap plate is located behind the cabinet cladding and has "wrapper" or hinge screw holes for clamping the position of the external hinge with hinge screws, while allowing for factory adjustment of the door position. After the door is factory adjusted in position, a supplemental mechanism is applied to fix the tap plate in the factory position independent of the hinge screws, such as an epoxy application or a separate and independent drill screw applied through the cabinet and engaging the tap plate.

8 Claims, 4 Drawing Sheets

FIXED HINGE-DOOR REMOVAL/DOOR SEAL RESOLUTION

BACKGROUND OF THE INVENTION

The present invention relates to a refrigerator hinge assembly and a method for hanging a refrigerator door wherein the refrigerator door has a flexible door seal, wherein the door can be accurately positioned in a factory to a preset orientation, removed in the field, and reinstalled with precision to the preset orientation.

Conventionally, doors for refrigerator cabinets have door hinges which are slotted to allow for tolerance variation in the components for properly aligning the door and the door seal with the refrigerator cabinet in the factory. A loose tap plate is located beneath the cabinet "wrapper" or outer paneling and contains mounting holes to secure the hinge to the outside of the cabinet wrapper. Door hinge assemblies are shown, for example, in U.S. Pat. No. 3,290,109 and U.S. Pat. No. 4,864,691.

When refrigerator doors are hung on a cabinet, an assembly fixture engages and sets the door to the factory specifications regarding the door seal. However, when the doors are removed in the field in order to deliver the product through narrow doorways of a typical home, the factory settings are lost and a field adjustment is required which is susceptible to inaccurate and imprecise door seal settings. A large service incident rate, for example, for side by side refrigerators is in door seal and alignment service calls.

SUMMARY OF THE INVENTION

It is an object of the present invention to provide a door hinge for an appliance such as for a refrigerator which can be properly adjusted in the factory to ensure a correct door orientation for the door seal to seal properly against the refrigerator cabinet. It is an object of the present invention to provide a factory settable refrigerator door hinge which fixes the door position for proper sealing against a refrigerator cabinet and which provides a repeatable reinstallation of the door to maintain a proper seal. It is an object of the present invention to provide a refrigerator door hinge which is easily assembled, adjusted and disassembled and reinstalled.

The objects of the invention are inventively achieved in that a tap plate is provided beneath the cabinet wrapper and pressable against an underside thereof. The tap plate can be encapsulated in a styrobead block but allowed to move parallel to the wrapper surface. Holes are provided in the wrapper, enlarged to allow for screw clearance and tap plate movement during factory adjustment. The hinges to be affixed thereto has fixed round holes with no adjustment. In the factory, process fixtures are used to position the hinges in the proper location to meet door seal dimensional requirements. Self tapping screws can be used to fasten the hinges to the floating tap plate. In one embodiment, a special drill screw is driven through the cabinet wrapper and into the tap plate. This drill screw fixes the tap plate in position with regard to the refrigerator cabinet, i.e., to the cabinet wrapper. Subsequently, if the doors are removed in the field, the doors can be automatically reinstalled back to the original factory setting due to the fact that the tap plates are now fixed in position with respect to the cabinet. If for any reason adjustment is necessary, the drill screw can be removed to allow the hinges and tap plate to again float for any necessary adjustment.

In another inventive embodiment, the tap plate rests against an underside of the cabinet wrapper. The styrobead block encapsulates the tap plate yet allows it to move parallel to the wrapper's surface. Holes in the wrapper are enlarged to allow for screw clearance and tap plate movement. Hinges have fixed round holes with no adjustment. Prior to installing the doors, epoxy is inserted between the tap plates and the wrapper. Process fixtures are used to position the hinges in the proper location to meet door seal dimensional requirements. Self tapping screws may be used to fasten the hinges to the floating tap plates. After the epoxy sets, the tap plate is effectively fixed in position. When the doors are removed in the field, the doors can be automatically reinstailed back to the original factory setting due to the fact that the tap plates are fixed in position with respect to the cabinet.

DETAILED DESCRIPTION OF THE PREFERRED EMBODIMENTS

Figure 1:
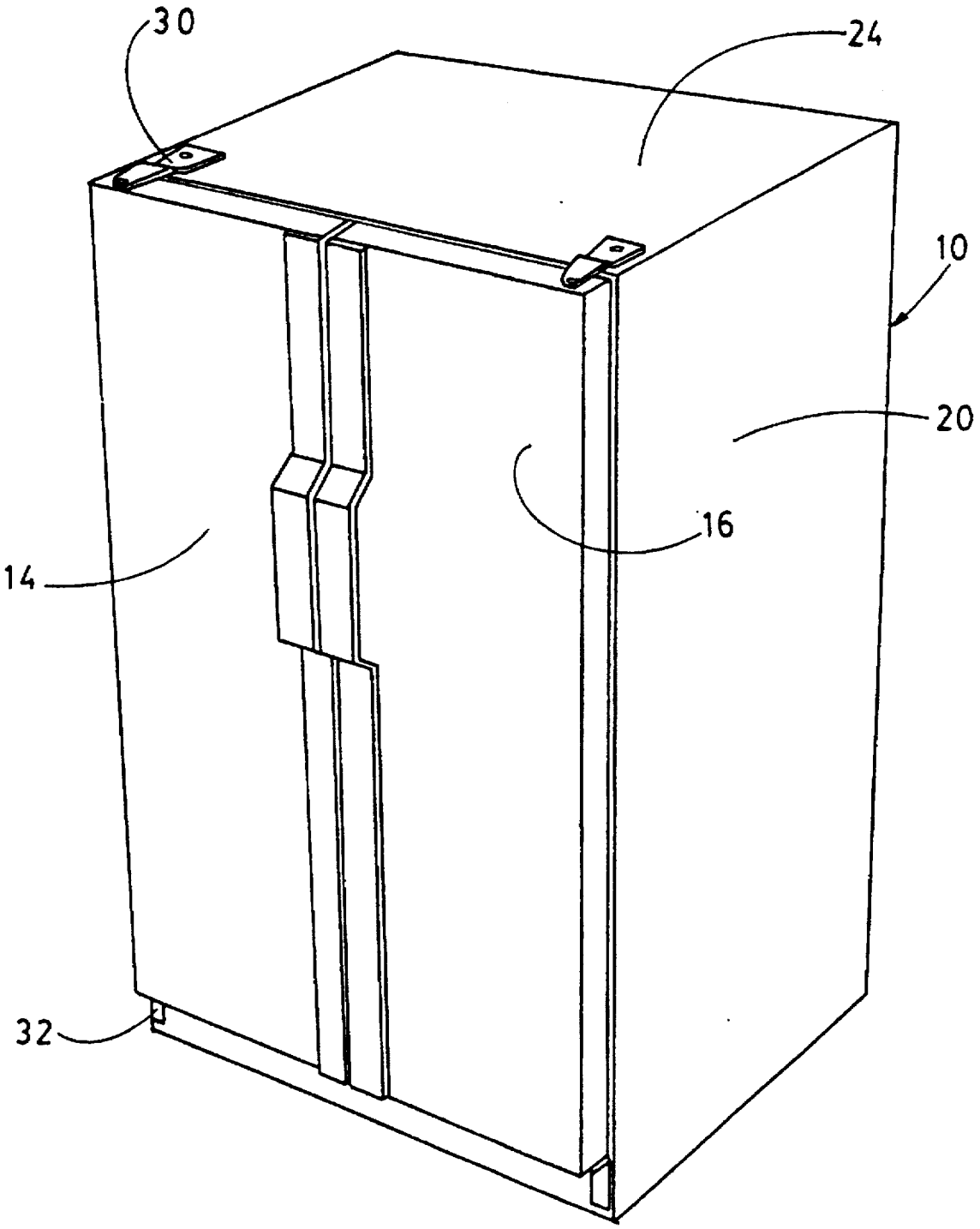
FIG. 1 is a perspective view of a refrigerator/freezer utilizing the hinge arrangement of the present invention.

FIG. 1 illustrates a refrigerator/freezer 10 of a side by side configuration. On a left side of the refrigerator/freezer is a freezer door 14 adjacent a right side refrigerator door 16. The doors 14, 16 are pivotally mounted to the appliance cabinet 20 having an outside cladding or "wrapper" 24. Beneath the wrapper is a layer of foamed in place styrobead type insulation 26 (shown in FIG. 2). The freezer door is mounted via an upper hinge assembly 30, and a lower hinge assembly 32.

Figure 2:
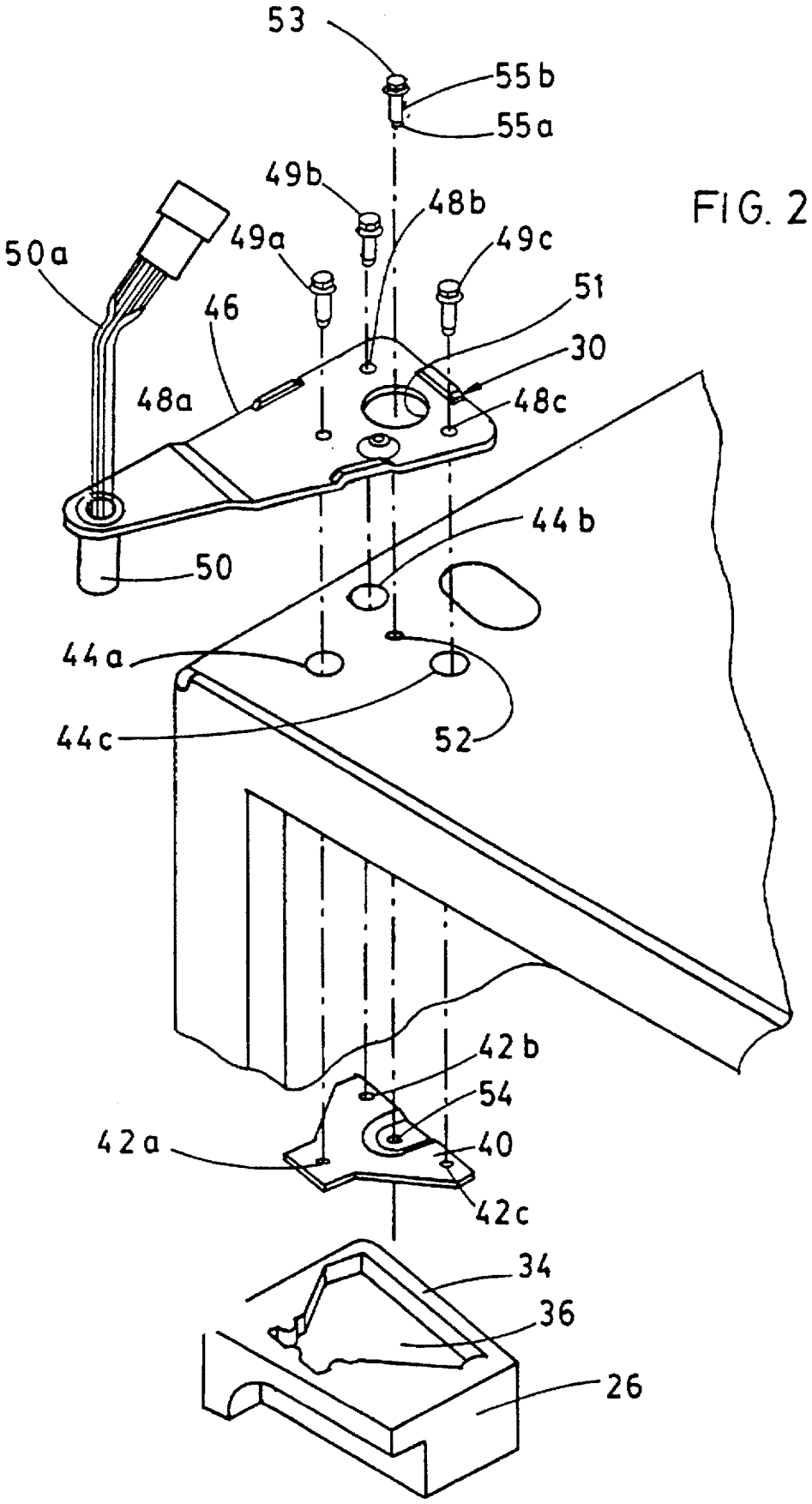
FIG. 2 is a partial exploded perspective view of an upper hinge assembly of the present invention.

As shown in FIG. 2, an encapsulation block 34 as part of the foamed in insulation 26 provides a substantially triangular recess 36 for receiving a tap plate 40 therein. The tap plate 40 is roughly positioned beneath the wrapper 20, and has tapped screw holes 42*a*, 42*b*, 42*c* therethrough. The wrapper provides enlarged wrapper holes 44*a*, 44*b*, 44*c* generally in registry with the tapped holes 42*a*, 42*b*, 42*c*. An upper hinge 46 is placed over the wrapper 20 and has screw holes 48*a*, 48*b*, 48*c* generally in registry with the holes 42*a*, 42*b*, 42*c*. Three hinge screws 49*a*, 49*b*, 49*c* insert through the screw holes 48*a*, 48*b*, 48*c*; through the enlarged wrapper holes 44*a*, 44*b*, 44*c* and engage and thread into the tap plate holes 42*a*, 42*b*, 42*c*. The holes 42*a*, 42*b*, 42*c* can be pre-tapped or tapped in place by the screws. Because the wrapper holes 44*a*, 44*b*, 44*c* are enlarged, there is some freedom of movement of the hinge on the wrapper, and corresponding movement of the tap plate beneath the wrapper to make hinge adjustments of the door in factory. Once the screws 49*a*, 49*b*, 49*c* are tightened down, the hinge and tap plate are fixed with respect to the wrapper and are clamped thereto.

The upper hinge provides a hollow pivot pin 50 which is received in a socket in the door 14 to allow pivoting of the door. Wires or water tubes 50*a* can be routed through the hollow pin.

The hinge 46 provides a window aperture 51 in a central region thereof. Once the hinge is aligned in the factory, a special drill screw 49c is positioned within the window aperture 51 and driven through the wrapper 20 forming an aperture 52, and into the tap plate 40 into a drilled aperture 54, and tightened to fix the position of the tap plate. Absent this fixation by the drill screw, the disassembly and reinstallation of the upper hinge 46 in the field would not be assured of a repeat factory setting because once dissembled the tap plate would be free to move. With the present invention, the special drill screw 49c locks the position of the tap plate beneath the wrapper in a factory fixed position so that the hinge 46 can be removed and the tap plate would be retained in its factory set fixed position. The hinge 46 can then be reinstailed with the three hinge screws. The drill screw provides a leading drill bit region 55a and a self tapping region 55b for simultaneous drilling and engaging of the drill screw into the tap plate 40.

Figure 3:
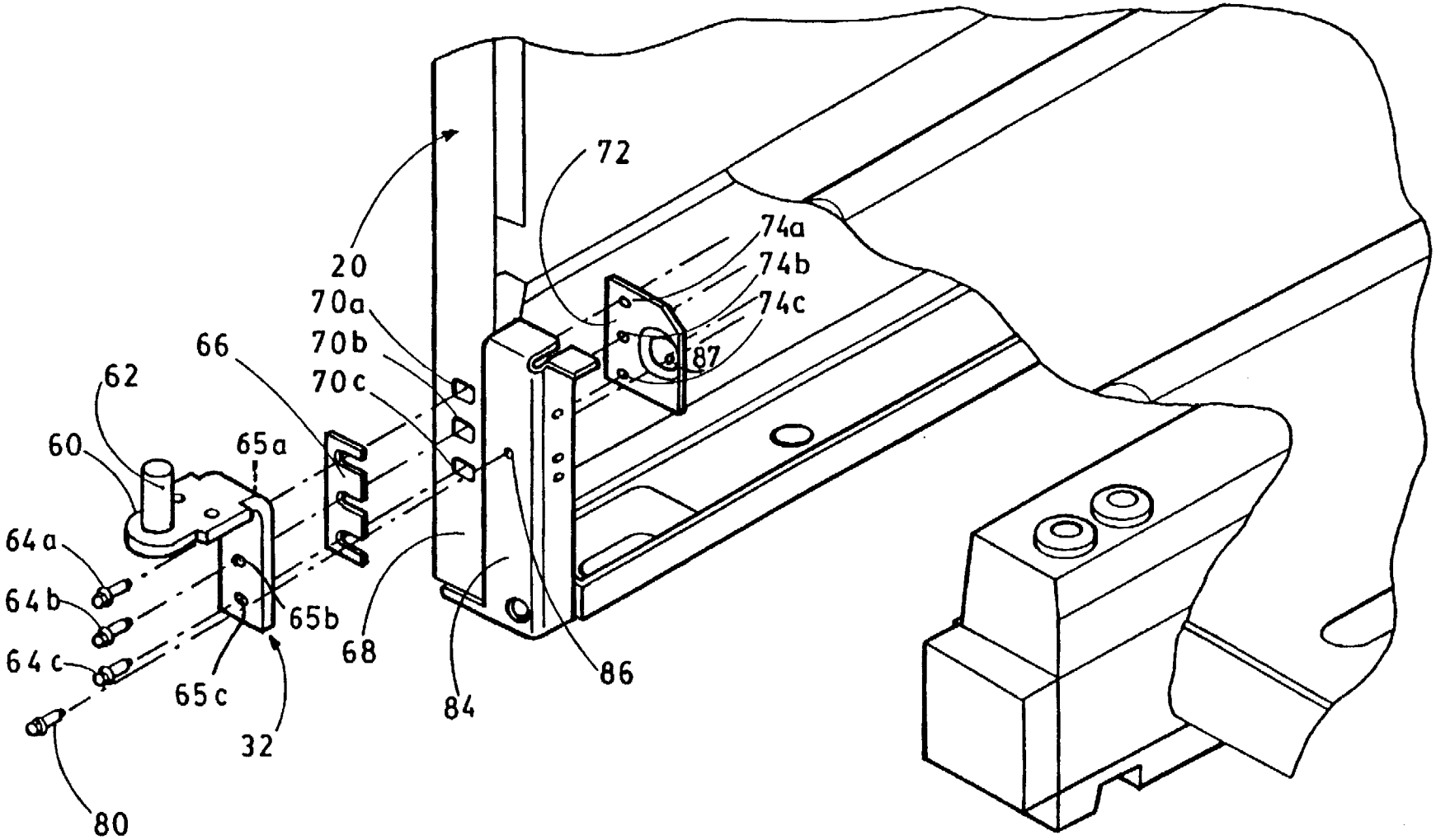
FIG. 3 is a partial perspective exploded view of a bottom hinge assembly of the present invention.

FIG. 3 illustrates the bottom hinge assembly 32 having a hinge 60 with an upwardly extending pin 62 for insertion into a door socket (not shown), and three hinge screws 64a, 64b, 64c inserted into screw holes 65a, 65b, 65c. A shim 66 is provided between the hinge 60 and a front side wall 68 of the wrapper. The front side wall provides three enlarged holes 70a, 70b, 70c substantially in registry with the holes 65a, 65b, 65c. A bottom tap plate 72 can be arranged on an inward side of the front side wall 68 and provides three tapped holes 74a, 74b, 74c substantially in registry with the holes 65a, 65b, 65c. When the bottom hinge 60 is installed in the factory, the three hinge screws 64a, 64b, 64c are inserted through the screw holes 65a, 65b, 65c, through the enlarged wrapper holes 70a, 70b, 70c and threaded into the tapped holes 74a, 74b,74c of the tap plate to draw the hinge 60 and the tap plate together on opposite sides of the front side wall 68. The holes 74a, 74b, 74c can be pre-tapped or tapped in place by the screws. Because of the oversized wrapper holes 70a, 70b, 70c, there is a degree of adjustment of the position of the hinge 60. After this adjustment has been accomplished in the factory, a special drill screw 80 is drilled through the front frame 84, forming an aperture 86, drills an aperture 87 and engages into that aperture 87 in the tap plate 72. As described above, this tightly fixes the position of the tap plate to the frame 84 so that the lower hinge 60 can be removed in the field and accurately reinstailed to match the factory setting set by the fixed tap plate 72. In the bottom hinge 60, the special drill screw is arranged adjacent the hinge 60.

Figure 4:
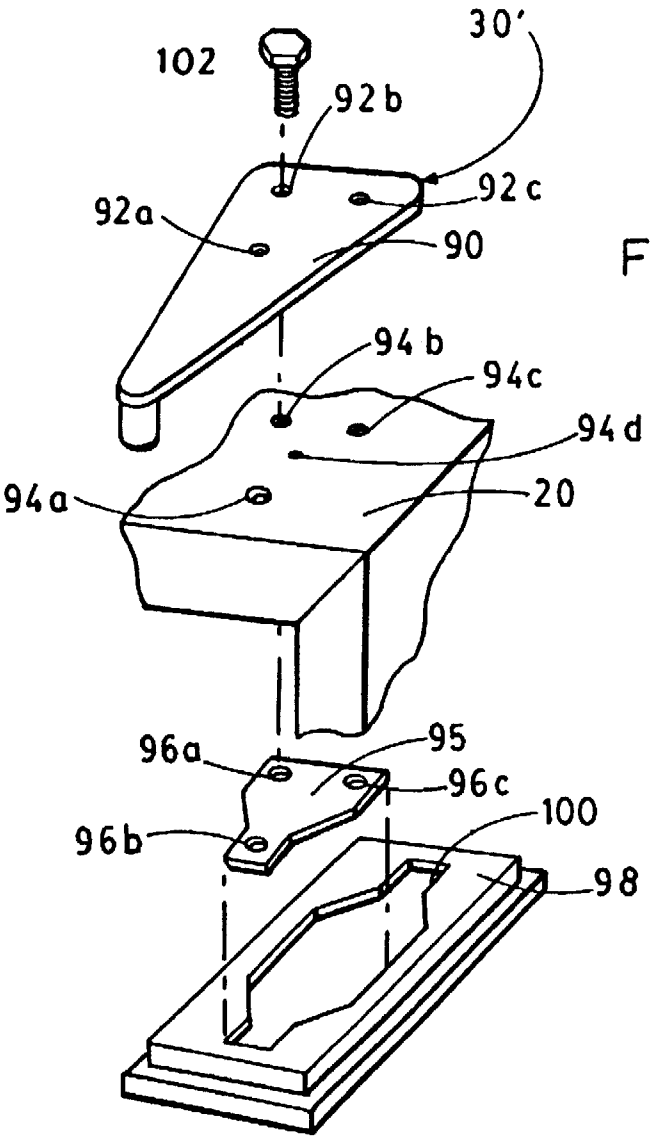
FIG. 4 is a partial perspective exploded view of an alternate hinge arrangement of the present invention.

FIG. 4 illustrates an alternate embodiment upper hinge assembly 30'. In this embodiment, a hinge 90 is provided with screw holes 92a, 92b, 92c which are arranged substantially in registry with enlarged wrapper holes 94a, 94b, 94c. Beneath the wrapper 20 is arranged a tap plate 95 having screw holes 96a, 96b, 96c. A foamed styrobead block 98 having a formed recess 100 to accept the tap plate 95 is provided beneath the wrapper. Advantageously, the recess 100 of the styrobead block 98 is bi-directional to be used on either side of the door. The block is pre-molded and integrated into the cabinet insulation by the foamed in place insulation process. Epoxy is inserted in hole 94d to flow between the wrapper 20 and the tap plate 95. Three screws 102 (only one shown), which can be self tapping screws if the holes 96a, 96b, 96c are not previously tapped, are applied through the hinge 90 through the enlarged holes 94a, 94b, 94c and engage the screw holes 96a, 96b, 96c to grip the hinge 90 to the tap plate 95 across the wrapper 20. The refrigerator or freezer door is factory positioned and the three screws 102 are drawn tight. After the epoxy sets, the tap plate will be permanently retained in its factory set position notwithstanding the fact that the hinge 90 may later be removed for transportation or field access purposes. When the hinge 90 is reinstailed, the tap plate 95 will be in its permanent factory set position beneath the enlarged holes 94a, 94b, 94c.

Figure 5:
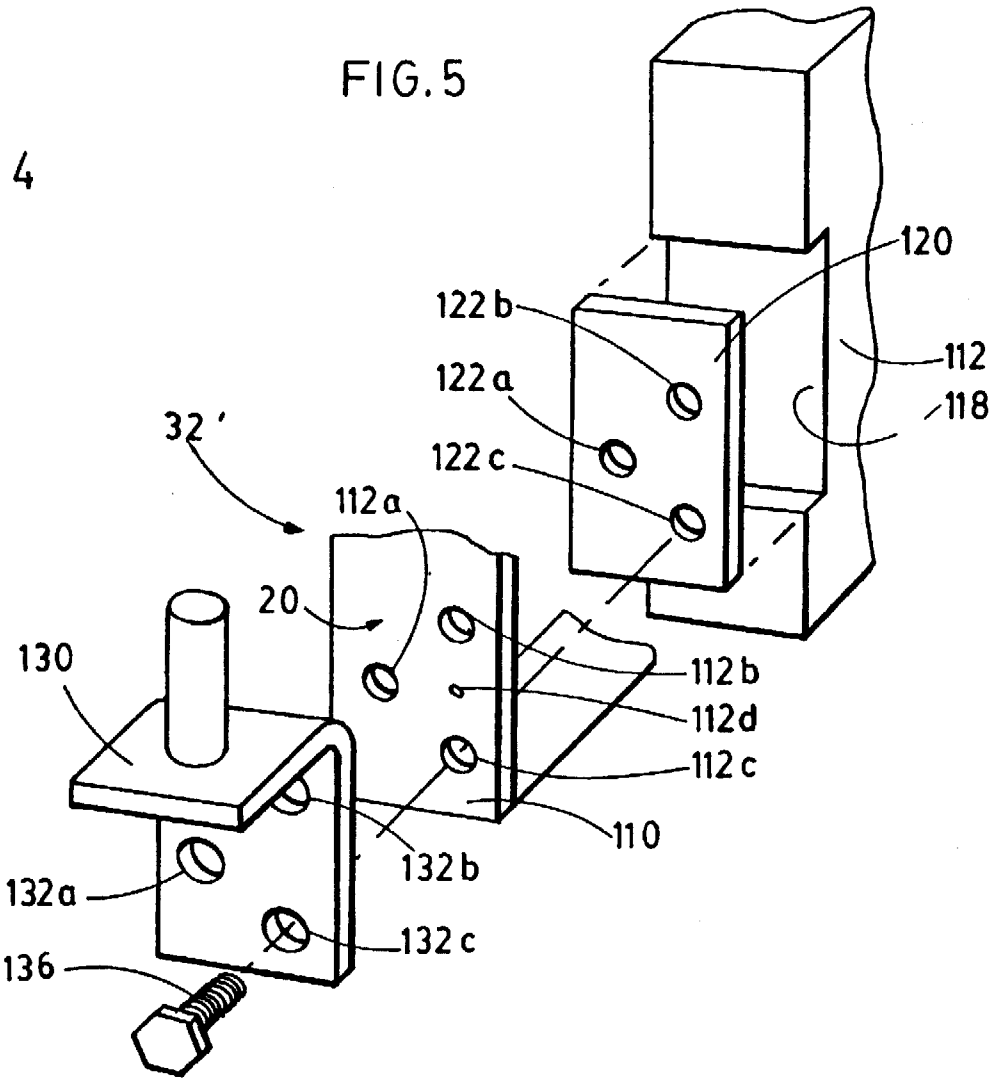
FIG. 5 is a partial perspective exploded view of an alternate embodiment lower hinge of the present invention.

FIG. 5 illustrates an alternate embodiment lower hinge assembly 32'. A front side panel 110 of the refrigerator or freezer is provided with enlarged holes 112a, 112b, 112c. A styrobead deck support 112 previously foamed in place behind the panel 110 provides a recess 118 in which fits a tap plate 120. The tap plate provides tapped screw holes 122a, 122b, 122c (tapped in place or pretapped) substantially in registry with the holes 112a, 112b, 112c. A bottom hinge 130 has screw holes 132a, 132b, 132c which are arranged in registry with the tapped holes 122a, 122b, 122c. Epoxy is inserted in hole 112d to flow between the wrapper 20 and the tap plate 120. Three screws such as self tapping screws 136 (only one shown) are inserted through the holes 132a, 132b, 132c through the enlarged holes 112a, 112b, 112c and engage into the holes 122a, 122b, 122c of the tap plate 120. The hinge 130 is adjusted in the factory and the screws 136a, 136b, 136c are drawn tight in the factory fixed position. When the epoxy sets, the tap plate is immobilized in this factory fixed position so that subsequent removal of the hinge 130 will not affect the factory set position. When the hinge 130 is reinstailed, the factory position will be resumed.

Although the present invention has been described with reference to a specific embodiment, those of skill in the art will recognize that changes may be made thereto without departing from the scope and spirit of the invention as set forth in the appended claims.

We claim as our invention:

1. A hinge assembly for mounting an appliance door, wherein the appliance provides a mounting surface adjacent the door, comprising:

a tap plate located on an inside of said mounting surface and fixed in a factory adjusted position;

a hinge located on an outside of said mounting surface substantially aligned with said tap plate;

said tap plate providing a plurality of screw engaging holes, said hinge providing a plurality of screw receiving holes each substantially aligned with one of said screw engaging holes, and said mounting surface having enlarged holes in registry with said screw receiving holes;

a plurality of screws for inserting through said screw receiving holes, said enlarged holes, and engaging said screw engaging holes to clamp said mounting surface between said hinge and said tap plate and thereby fix the position of said hinge relative to the tap plate; and a means for fixing said tap plate in the factory adjusted position relative to said mounting surface independent of said plurality of screws fixing the position of said hinge relative to the tap plate and so that the screw engaging holes of the tap plate cannot move relative to said mounting surface even upon removal of the plurality of screws and the hinge.

2. The assembly according to claim 1, wherein said means for fixing comprising an epoxy applied to said tap plate to adhesively secure said tap plate in a factory fixed position with respect to said mounting surface.

3. The assembly according to claim 2, wherein said appliance comprises a foamed in place block insulating material behind said mounting surface, said block material comprises a recess for receiving the tap plate.

4. The assembly according to claim 1, wherein said means for fixing comprises a screw connecting said tap plate to said mounting surface independent of said hinge.

5. The assembly according to claim 4, wherein said screw is a drill screw.

6. An appliance cabinet having at least one door and a cladding surrounding at least a portion of a door opening, comprising:

said door having upper and lower sockets;

an upper hinge having a hinge pin extending downwardly to be received into said upper socket of said door, and a lower hinge having a hinge pin extending upwardly to be engaged in said lower socket of said door;

said upper and lower hinges each having a plurality of screw receiving holes, a plurality of screws;

a pair of tap plates located behind said cabinet cladding and each having a plurality of screw engaging holes in registry with said screw receiving holes of a respective one of said hinges and being fixed in a factory adjusted position;

said plurality of screws penetrating said screw receiving holes, said cabinet cladding and engaging said screw engaging holes to draw said upper and lower hinges to said tap plates tightly and thereby fix said hinges relative to said tap plates;

means for permanently fixing said tap plate in said factory adjusted position to said cabinet cladding, independent of said plurality of screws fixing the position of said hinge relative to the tap plate and so that screw engaging holes of the tap plate cannot move relative to said cabinet cladding even upon removal of the screws and hinges.

7. The appliance according to claim 6, wherein said means for fixing comprising a drill screw penetrating said cabinet cladding and engaging said tap plate to holes of tap plate fixedly to said cabinet cladding.

8. The appliance according to claim 6, wherein said means for fixing comprises an amount of epoxy applied to said tap plate and fixing said tap plate in its factory installed position.

* * * * *